US006729386B1

(12) United States Patent
Sather

(10) Patent No.: US 6,729,386 B1
(45) Date of Patent: May 4, 2004

(54) PULP DRIER COIL WITH IMPROVED HEADER

(76) Inventor: Stanley H. Sather, 894 Citadel Drive, Port Coquitlam, British Columbia (CA), V3C 5Y1

( * ) Notice: Subject to any disclaimer, the term of this patent is extended or adjusted under 35 U.S.C. 154(b) by 0 days.

(21) Appl. No.: 09/765,569

(22) Filed: Jan. 22, 2001

(51) Int. Cl.[7] ..... F28B 1/00
(52) U.S. Cl. ..... 165/110; 165/174; 165/155
(58) Field of Search ..... 165/110, 174, 165/155, 111, 112, 113; 34/449, 122, 124

(56) References Cited

U.S. PATENT DOCUMENTS

| | | | | |
|---|---|---|---|---|
| 1,662,236 A | * | 3/1928 | Coupland | 165/110 |
| 1,788,296 A | | 1/1931 | Herndon | |
| 1,925,847 A | | 9/1933 | Prentice | |
| 2,278,086 A | | 3/1942 | Lea | |
| 2,587,720 A | | 3/1952 | Fritzberg | |
| 2,611,584 A | * | 9/1952 | Labus | 165/155 |
| 2,816,738 A | * | 12/1957 | Mcelgin | 165/155 |
| 2,840,161 A | | 6/1958 | Alexander et al. | |
| 2,864,500 A | | 12/1958 | Miller | |
| 2,942,858 A | * | 6/1960 | Stoneburner | 165/155 |
| 2,963,052 A | | 12/1960 | Cook | |
| 3,026,092 A | | 3/1962 | Pellegrini | |
| 3,126,332 A | | 3/1964 | Alete | |
| 3,243,042 A | | 3/1966 | Moulton | |
| 3,352,418 A | | 11/1967 | Swallow | |
| 3,516,483 A | * | 6/1970 | Benteler et al. | 165/174 |
| 3,922,880 A | * | 12/1975 | Morris | 62/498 |
| 4,443,332 A | | 4/1984 | de Nevers | |
| 4,881,596 A | * | 11/1989 | Bergmann et al. | 165/174 |
| 4,909,309 A | | 3/1990 | Palfalvi et al. | |
| 5,310,482 A | | 5/1994 | Sather | |
| 5,383,288 A | | 1/1995 | Ilmarinen | |
| 5,782,293 A | | 7/1998 | Sather | |
| 5,806,586 A | * | 9/1998 | Osthues et al. | 165/174 |
| 5,960,557 A | | 10/1999 | Sather | |

FOREIGN PATENT DOCUMENTS

| | | |
|---|---|---|
| CA | 2160274 | 5/1939 |
| CA | 1253894 | 5/1989 |
| CA | 1259344 | 9/1989 |
| CA | 2040827 | 7/1992 |
| CA | 2096262 | 11/1994 |
| CA | 1335497 | 5/1995 |
| CA | 2197254 | 8/1998 |
| GB | 533858 | 2/1941 |
| GB | 549365 | 11/1942 |
| GB | 962753 | 7/1964 |

* cited by examiner

*Primary Examiner*—Henry Bennett
*Assistant Examiner*—Terrell McKinnon
(74) *Attorney, Agent, or Firm*—Norman M. Cameron

(57) ABSTRACT

A steam heat exchanger for a wood pulp dryer includes a plurality of tubes. The tubes extend between the ends of the heat exchanger in parallel, spaced-apart relationship. There is a steam inlet header near a first end of the heat exchanger and an outlet header near a second end of the heat exchanger. The inlet header has an inner conduit and a plurality of openings spaced-apart therein for discharging steam from the inner conduit. An outer conduit extends about the inner conduit. The inlet ends of the tubes are connected to the outer conduit. The openings in the inner conduit each have a first end and a second end. The first end is closer to the first end of the inner conduit than the second end. In one embodiment the first end of each of the openings is further from the central axis of the inner conduit than the second end thereof. There may be a mount for the inner conduit which is fixedly connected to the outer conduit at a closed outer end thereof. The inner conduit extends slidably into the second end of the inner conduit. There are at least two rows of tubes, the first row of tubes being first exposed to a flow of air through the heat exchanger. A flow restrictor is located between the inlet header and the tubes of the second row, whereby a flow of steam through the second row of tubes is reduced compared to a flow of steam through the first row of tubes. Preferably there are three rows of tubes, the third row being between the first and second rows.

14 Claims, 4 Drawing Sheets

PULP DRIER COIL WITH IMPROVED HEADER

BACKGROUND OF THE INVENTION

1. Field of the Invention

This invention relates to steam heat exchangers for wood pulp dryers.

2. Description of the Related Art

Pulp dryers are conventionally used to dry wood pulp in sheet form prior to shipment. Heat is applied to the pulp by heating air with heat exchangers, normally heated with steam, and blowing the air against the web of pulp. The type of heat exchanger used on many dryers built have a frame with a plurality of spaced-apart, vertical copper tubes extending between opposite ends thereof. The tubes extend tightly through fins, usually of aluminum, which are perpendicular to the tubes. The tops of the tubes are connected to an inlet header which is typically perpendicular to the tubes. The bottoms of the tubes are connected to an outlet header. Steam is conventionally fed into the heat exchangers via T fittings on vertical steam pipes.

However, the life span of such prior art heat exchangers has been less than desirable. In some cases the life expectancy has been approximately 8 years, whereas a life span of 16–20 years is expected by many in the pulp industry. Pulp dryers have many heat exchangers and it is expensive to replace them, both in terms of the cost of the new heat exchangers, the labor required to replace them, and the down time of the pulp dryer needed to carry out this maintenance operation.

The failure of some prior art heat exchangers is believed to be due to a combination of problems. In addition, the arrangement of the inlet header appears to cause an uneven distribution of steam in the various tubes of each heat exchanger. The tubes carrying higher steam flow wear faster. In some mills steam becomes contaminated with chemicals and by-products of the pulp conversion process from time to time, the most common being known as black liquor. This material coats and ultimately corrodes the tubes.

In my earlier Canadian Patent No. 2,040,827 and U.S. Pat. No. 5,782,293 I disclosed the concept of a steam coil with an inlet header having inner and outer conduits. The inner conduit has openings in the top which allow steam to pass into the space between the inner conduit and outer conduit which is connected to the tubes of the steam coil. Impurities are diverted along the inner conduit to a diverter conduit to reduce possible contamination of the tubes with black liquor or other contaminants. The openings in the top of the inner conduit are louvered or tear-drop shaped.

However, the life span of heat exchangers or steam coils has still been less than desirable. I have ascertained that this is due to a number of factors. On factor is that distribution of steam is less than optimal among the different tubes of each heat exchanger. This leads to accumulation of condensation and premature wear of the tubes.

This factor is particularly notable in heat exchangers having three rows of tubes. The majority of heat exchange occurs with the first row of tubes which is exposed first to the air. Accordingly, most of the condensation occurs in the first row. A relatively small amount of heat exchange occurs in the third row of tubes, for example about 9% of the heat exchange in some examples. Little condensation therefore occurs in the third row. Steam is typically fed from the inlet header at the tops of the tubes. This tends to go straight down the third row of tubes and then back up through the first and second rows of tubes. This holds up condensate in the first and second rows due to the reverse flow of steam coming from the bottom instead of the top. The condensate held up in the first and second rows causes premature erosion and corrosion of the tubes and therefore premature failure of the steam coils.

Another problem is caused by mechanical failure of inlet headers of the type having two concentric tubes. This failure often occurs adjacent the end of the header which is opposite the inlet end. This occurs because of differential expansion and contraction between the inner and outer tubes and the structure connecting them.

Accordingly it is an object of the invention to provide an improved heat exchanger for pulp dryers which provides better distribution of steam from the inlet header to the tubes.

It is also an object of the invention to provide an improved heat exchanger for pulp dryers having two or more rows of tubes, such that short circuiting of steam is inhibited up through the rows of tubes first exposed to the flow of air. This prevents uncondensed steam from the last row of tubes from entering the bottom of the first row of tubes.

It is a further object of the invention to provide an improved heat exchanger for pulp dryers, of the type having concentric tubes, whereby mechanical failures between the concentric tubes is reduced.

SUMMARY OF THE INVENTION

In accordance with these objects there is provided, according to one aspect of the invention, a steam heat exchanger for a wood pulp dryer. The heat exchanger has a first end, a second end which is opposite the first end and includes a plurality of tubes. Each tube has an inlet end and an outlet end. The tubes extend between the ends of the heat exchanger in parallel, spaced-apart relationship to each other. There is an outlet header near the second end of the heat exchanger. The outlet ends of the tubes are connected to the outlet header. There is a steam inlet header near the first end of the heat exchanger. The inlet header has an inner conduit with an outer surface, a central axis, a connector at a first end thereof for connecting the inner conduit to a source of steam and a plurality of openings spaced-apart therein for discharging steam from the inner conduit. An outer conduit extends about the inner conduit. The inner ends of the tubes are connected to the outer conduit. The openings in the inner conduit each have a first end and a second end. The first end of each opening is closer to the first end of the conduit than the second end of each opening. The first end of each opening is firther from the central axis of the inner conduit than the second end thereof.

According to another aspect of the invention there is provided a steam heat exchanger for a wood pulp dryer. The heat exchanger has a first end, a second end which is opposite the first end and includes a plurality of tubes. Each tube has inlet end and an outlet end. The tubes extend between the ends of the heat exchanger in parallel, spaced-apart relationship to each other. There is an outlet header near the second end of the heat exchanger. The outlet ends of the tubes are connected to the outlet header. There is a steam inlet header near the first end of the heat exchanger. The inlet header has an inner conduit with an outer surface, a central axis, a first end, a second end opposite the first end, a connector at the first end thereof for connecting the inner conduit to a source of steam and a plurality of openings spaced-apart therein for discharging steam from the inner conduit. An outer conduit extends about the inner conduit. The inlet ends of the tubes are connected to the outer conduit. The outer conduit has a closed end adjacent the second end of the inner conduit. There is a mount for the inner conduit which is fixedly connected to the closed end of the outer conduit and which slidably engages the second end of the inner conduit.

There is provided, according to a further aspect of the invention, a steam heat exchanger for a wood pulp dryer having a first end, a second end which is opposite the first end, a first side onto which air is directed and a second side which is opposite to the first side. There is a plurality of tubes, each having an inlet end and an outlet end. The tubes extend between the ends of the heat exchanger in parallel, spaced-apart relationship to each other. The tubes are arranged in a first row and a second row. The first row is adjacent to the first side of the heat exchanger and the second row is further from the first side than the first row. There is an outlet header near the second end of the heat exchanger. The outlet ends of the tubes are connected to the outlet header. There is a steam inlet header near the first end of the heat exchanger. The inlet ends of the tubes are connected to the inlet header. A flow restrictor is operatively located between the inlet header and the outlet ends of tubes of the second row. A flow of steam through the second row of tubes is reduced compared to a flow of steam through the first row of tubes. Preferably the flow restrictors are adjacent the inlet ends of the tubes. Preferably there is a third row of tubes between the first and second rows.

DETAILED DESCRIPTION OF THE PREFERRED EMBODIMENTS

Figure 1:
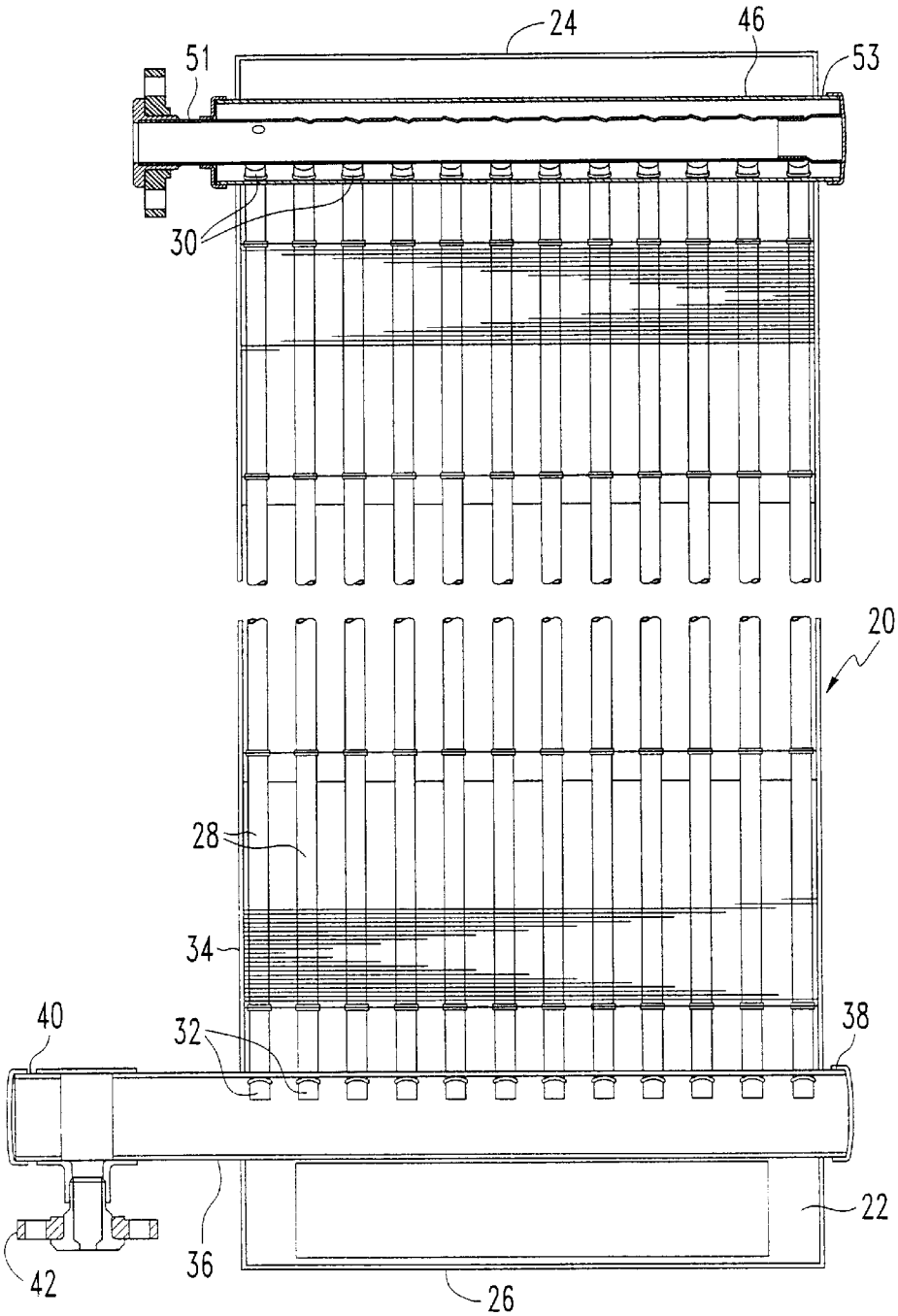
FIG. 1 is a front view, partly broken away, of a heat exchanger for a pulp dryer according to an embodiment of the invention.

Referring to FIG. 1, this shows a steam heat exchanger 20, commonly known as a "steam coil". It has a perimeter frame 22 made of galvanized steel in this example, though other materials could be substituted. The heat exchanger has a top 24 and a bottom 26 at opposite ends of the heat exchanger.

The heat exchanger has a plurality of tubes 28 which extend between the ends of the heat exchanger in parallel spaced-apart relationship to each other. Each tube has an inlet end 30 and an outlet end 32. The tubes are of copper in this example although other metals could be substituted. Copper is preferred because of its heat transfer abilities. Silver brazing is used in the example to connect the components of the heat exchanger together.

There is a plurality of fins 34, shown in fragment, which are fitted about the tubes and which extend perpendicularly thereto. Nearly the entire area between the ends of the tubes would normally be fitted with spaced-apart fins. The fins in this example are of aluminum which is preferred because of its high rate of heat transfer as well as its economy. However other metals could be substituted.

Heat exchanger 20 has an outlet header 36 near its bottom or second end 26. The outlet header in this example is a straight, elongated pipe which is perpendicular to the tubes 28. The outlet header is of copper in this example although other metals could be substituted. The outlet ends 32 of the tubes 28 are connected to the outlet header. The outlet header has a first end 3 8 and a second end 40. The outlet header is preferably sloped slightly vertical towards the second end 40, which is the outlet end, to drain condensate. There is a fitting 42 on the second end which allows the outlet header to be connected to a condensate return line.

Heat exchanger 20 also includes a steam inlet header 46 which is located adjacent its first end 24. The header is elongated and perpendicular to tubes 28. The tubes are connected to this header which supplies steam to the tubes. The inlet header has a first end 51 and a second end 53.

Figure 5:
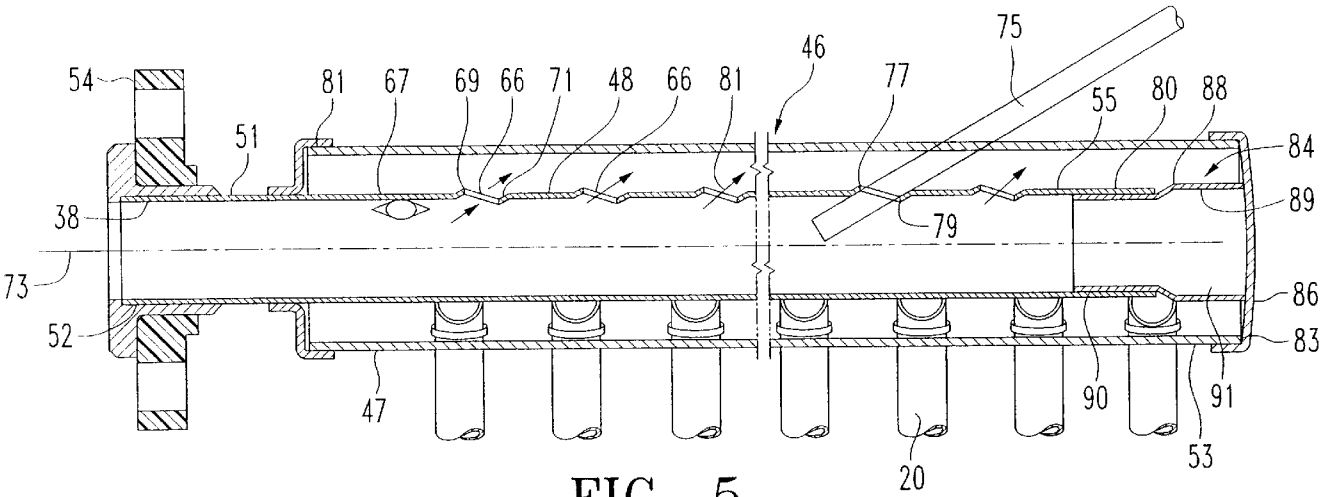
FIG. 5 is a fragmentary sectional view of the inlet header of the heat exchanger of FIG. 1 and showing a tool used to form inclined openings in the inner tube.

As seen in better detail in FIG. 5, the inlet header 46 has an inner conduit 48 with a first end 52 and a second end 80. A flange 54 at the first end is used to connect the inner conduit to a source of steam, typically a steam pipe.

Figure 7:
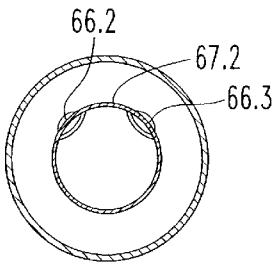
FIG. 7 is a view similar to FIG. 6 showing two rows of openings in the inner tube.

The inner conduit 48 has a series of openings 66 which are adjacent top 67 thereof. In this example the openings are circular and are spaced-apart along the conduit. FIG. 7 shows a variation where there are two rows of openings 66.2 and 66.3 extending just below the top 67.2 along opposite sides of the inner conduit.

As best seen in FIG. 5, each of the openings 66 has a first end 69 and a second end 71. The first end 69 of each opening is closer to first end 38 of the inner conduit than the second end. Also the first end 69 is located further from central axis 73 of the inner conduit than the second end. In other words, the openings 69 are inclined towards the second end.

FIG. 5 shows a tool 75 which is used to form these inclined openings. The tool is simply a rod slightly smaller in diameter than the openings. The openings are drilled in the inner conduit in the normal manner. The tool is then placed in each opening prior to assembly of the inlet header. The tool is then tilted to the position shown in FIG. 5 which forms the inclined opening.

It may be seen that the inner conduit has an outwardly extending edge 77 adjacent the first end of each opening and an inwardly extending edge 79 adjacent the second end of each opening. Edge 77 is outwardly concave, while edge 79 is inwardly concave.

The sloped nature of the openings 66 leads to better steam distribution between the inner conduit and the outer conduit and accordingly better distribution through the tubes 28. Instead of the steam rushing past the openings, the steam is diverted out through the openings as shown by arrows 81.

The inlet header has an outer conduit 47 with a first end 81 and a second end 83 adjacent to the second end 80 of the inner conduit. This end is closed by a cap 86 which is fitted over the end 83 of the outer conduit and sealed by brazing in this particular example. There is a mount 88 for the second end of the inner conduit which is connected to the closed end of the outer conduit on the inside thereof, again by brazing in this particular example. The mount is tubular having a larger diameter portion 89 adjacent to the cap 86 and a smaller diameter portion 90 which extends inside the end 80 of the inner conduit. The mount extends slidably, but relatively tightly into the second end of the inner conduit. This allows relatively little steam to escape from the second end of the inner conduit. There is a drain hole 91 at the bottom of the mount which allows any condensation to drain.

The slidable connection between the mount and the second end of the inner conduit allows for a certain amount of play between the inner conduit and the outer conduit. In some prior art heat exchangers the connection has been a rigid one and this may result in failure due to differential expansion and movement between the inner conduit and the outer conduit. The slidable connection prevents such failure.

Figure 2:
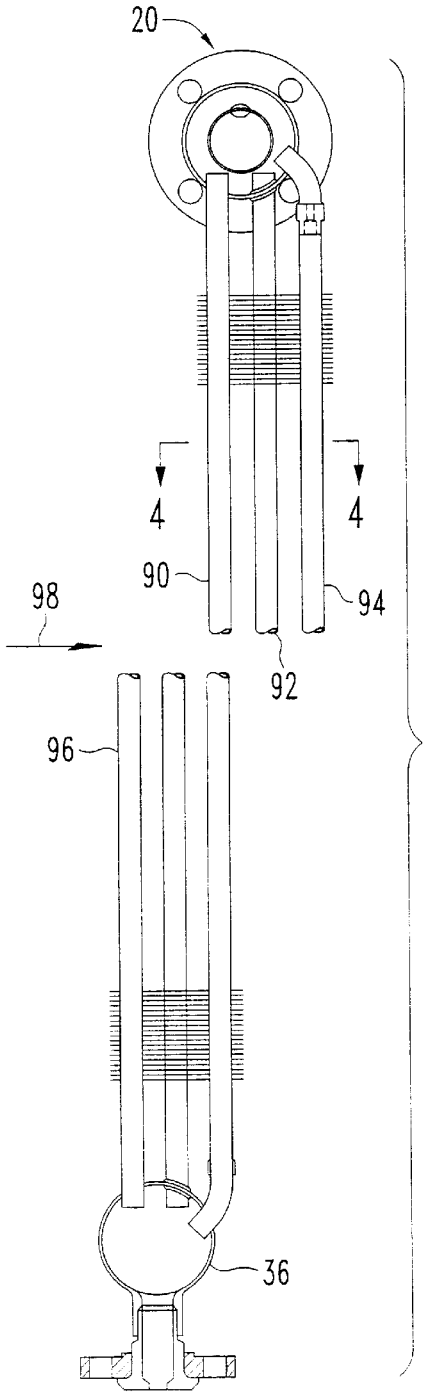
FIG. 2 is a fragmentary end view thereof.
Figure 4:
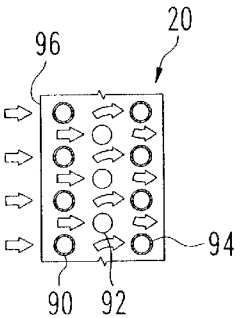
FIG. 4 is a simplified section taken along line 4—4 of FIG. 2.
Figure 8:
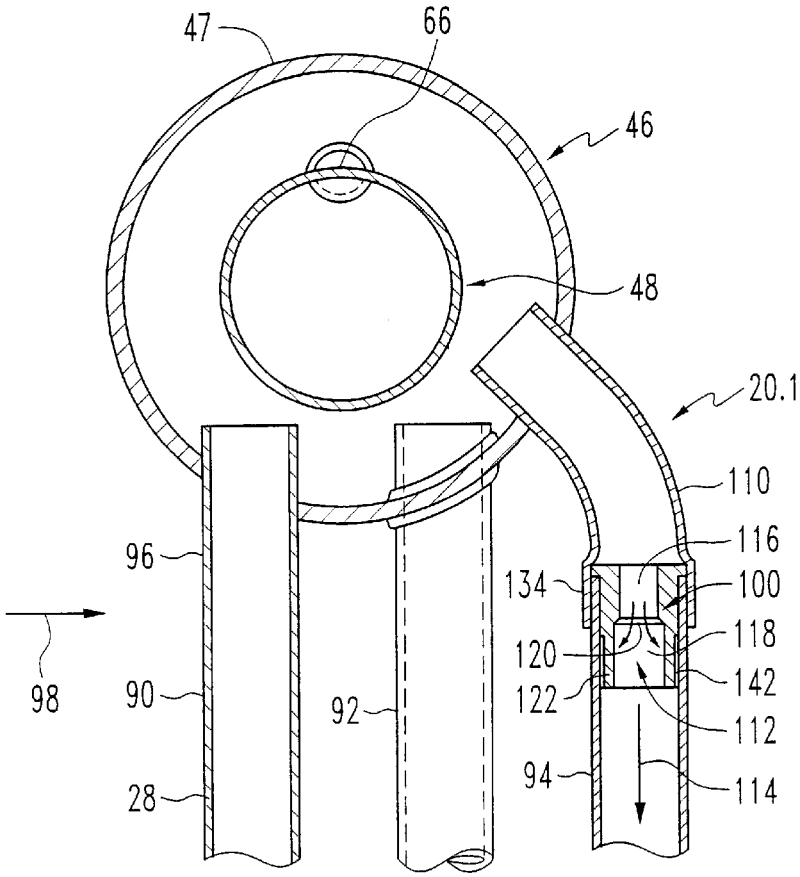
FIG. 8 is a view similar to FIG. 6 for the heat exchanger of FIG. 1.

As seen in FIGS. 2, 4 and 8, the tubes 28 are in three rows. FIG. 2 shows three tubes 90, 92 and 94 representing one tube for each of the rows. A first row of tubes, represented by tube 90, is on a first side 96 of heat exchanger 20 which is the side onto which the air is directed as indicated by arrow 98. A second row of tubes, represented by tube 94, is on the opposite side of the heat exchanger. The third row, represented by tube 92 is in between.

A problem occurs with prior art heat exchangers due to differential heat exchange and condensation in the three different rows. Because the row represented by tube 90 is the first contacted by the air, most of the heat exchange and condensation occurs in this row, while relatively little occur in the row with tube 94. The result is that a significant portion of the steam passing downwardly through tube 94, and the other tubes of the same row, enter the outlet header 36 at the bottom of the heat exchanger. The steam then passes upwardly through the rows of tubes represented by tubes 90 and 92, preventing condensation from properly draining from those tubes. The condensation held up in the tubes causes premature erosion and corrosion of the tubes.

Figure 9:
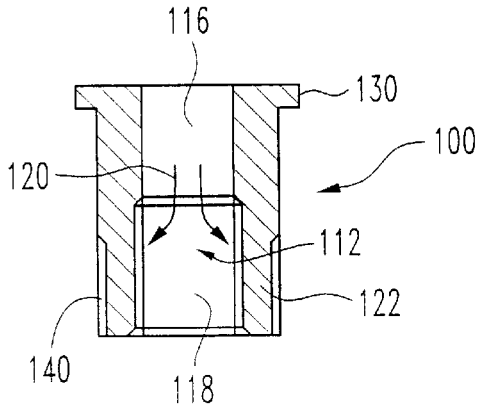
FIG. 9 is a sectional view of the flow reducer from FIG. 8.

In order to remove this problem, the invention employs a flow restrictor 100 in each tube 94 shown best in FIGS. 8 and 9. The restrictor restricts the amount of steam that can pass downwardly through each of the tubes 94 to approximate the amount of steam which can be properly condensed within the tubes. This means that there is little or no excess steam passing through these tubes into the outlet header which would tend to pass upwardly through the tubes 90 and 92.

Each of the tubes 94 has an elbow 110 at the top thereof which connects with the outer conduit 47 of the inlet header. The flow restrictor is placed adjacent to the bottom of this elbow in this example though it could be placed elsewhere in each tube 94. This means that the stream of steam passing through orifice 112 in the flow restrictor passes directly down the tube, as indicated by arrow 114, instead of impacting on the wall of the elbow as may occur if the flow restrictor were placed further up the elbow.

In addition, the orifice 112 has a narrower upper part 116 and a wider lower portion 118. This means that the steam diverges within the flow restrictor, as indicated by arrows 120. The steam impacts wall 122 of the flow restrictor instead of impacting the wall of the tube 94 as would occur, for example, if a disc-like flow restrictor were used. Thus wear caused by the steam causes only wear or erosion of the thicker wall of the restrictor instead of causing wear and premature failure of the wall of the tube itself.

The flow restrictor, tube and elbow assembly are assembled upside down from the point of view of FIGS. 8 and 9. First the flow restrictor is tapped into the end of the tube until the tube contacts flange 130 shown in FIG. 9. The tube and flow restrictor assembly are then fitted into enlarged end 134 of the elbow. The elbow is then brazed to the tube. Because of the inverted position described above, the solder flows downwardly and capillary action tends to carry the solder upwardly between the flow restrictor and the tube. However the flow restrictor has a section 140 of reduced external diameter as seen in FIG. 9. This is at the top of the flow restrictor during assembly. A space 142, shown in FIG. 8, between the inside of the tube and the section 140 of the flow restrictor, stops upward capillary action of the solder which might otherwise enter the opening 112 and clog the flow restrictor.

Figure 3:
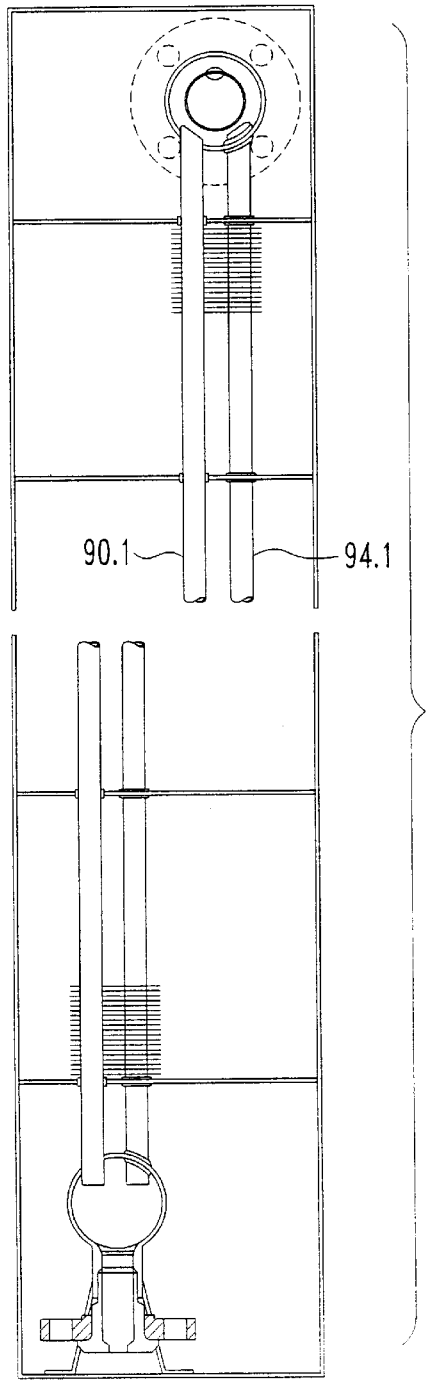
FIG. 3 is a fragmentary end view of an alternative embodiment having two rows of tubes.
Figure 6:
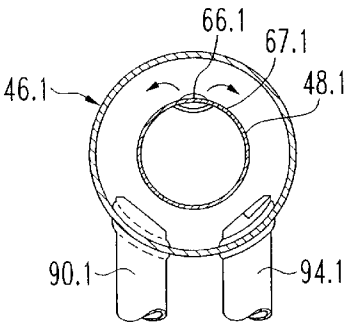
FIG. 6 is an end, sectional view of the header for the embodiment of FIG. 3 showing a single row of openings in the inner tube.

FIGS. 3 and 6 show a variation having two rows of tubes 90.1 and 94.1, but no middle row.

It will be understood by someone skilled in the art that many of the details provided above are by way of example only and are not intended to limit the scope of the invention which is to be interpreted with reference to the following claims.

What is claimed is:

1. A steam heat exchanger for a wood pulp dryer, the heat exchanger having a first end, a second end which is opposite the first end, and comprising:

a plurality of tubes, each having an inlet end and an outlet end, the tubes extending between the ends of the heat exchanger in parallel, spaced-apart relationship to each other;

an outlet header near the second end of the heat exchanger, the outlet ends of the tubes being connected to the outlet header; and a steam inlet header near the first end of the heat exchanger, the inlet header having an inner conduit with an outer surface, a central axis, a connector at a first end thereof for connecting the inner conduit to a source of steam and a plurality of openings spaced-apart therein for discharging steam from the inner conduit, and an outer conduit extending about the inner conduit, the inlet ends of the tubes being connected to the outer conduit, the openings in the inner conduit each having a first end and a second end, the first end being closer to the first end of the inner conduit than the second end, the first end of said each opening being further from the central axis of the inner conduit than the second end thereof, the openings each having edges which are inclined with respect to the outer surface of the inner conduit.

2. The heat exchanger as claimed in claim 1, wherein the openings are circular.

3. The heat exchanger as claimed in claim 1, wherein the edge adjacent the first end of each opening is outwardly concave and the edge adjacent to second end thereof is inwardly concave.

4. A steam heat exchanger for a wood pulp dryer, the heat exchanger having a first end, a second end which is opposite the first end, and comprising:

a plurality of tubes, each having an inlet end and an outlet end, the tubes extending between the ends of the heat exchanger in parallel, spaced-apart relationship to each other;

an outlet header near the second end of the heat exchanger, the outlet ends of the tubes being connected to the outlet header; and a steam inlet header near the first end of the heat exchanger, the inlet header having an inner conduit with an outer surface, a central axis, a first end, a second end opposite the first end, a connector at the first end thereof for connecting the inner conduit to a source of steam and a plurality of openings spaced-apart therein for discharging steam from the inner conduit, the inner conduit being a tube, and an outer conduit extending about the inner conduit, the inlet ends of the tubes being connected to the outer conduit, the outer conduit having a closed end adjacent the second end of the inner conduit, a mount for the inner conduit being fixedly connected to the closed end of the outer conduit and slidably engaging the second end of the inner conduit, the mount having an exterior shape similar to the inside of the tube.

5. The steam heat exchanger as claimed in claim 4, wherein the tube and the exterior shape of the mount are circular in section.

6. The steam heat exchanger as claimed in claim 5, wherein the outer conduit has an end cap on the closed end thereof, the end cap having an inner surface, the mount being connected to the inner surface and extending towards the inner conduit.

7. The steam heat exchanger as claimed in claim 6, wherein the mount is tubular and fits slidably within the second end of the inner conduit.

8. The steam heat exchanger as claimed in claim 7, wherein the mount has a bottom with a drain hole therein.

9. A steam heat exchanger for a wood pulp dryer, the heat exchanger having a first end, a second end which is opposite the first end, a first side onto which air is directed, a second side which is opposite to the first side, and comprising:

a plurality of tubes, each having an inlet end and an outlet end, the tubes extending between the ends of the heat exchanger in parallel, spaced-apart relationship to each other, the tubes being arranged in a first row and a second row, the first row being adjacent to the first side of the heat exchanger and the second row being further from the first side than the first row;

an outlet header near the second end of the heat exchanger, the outlet ends of the tubes being connected to the outlet header;

a steam inlet header near the first end of the heat exchanger, the inlet ends of the tubes being connected to the inlet header; and a flow restrictor located operatively between the inlet header and the outlet ends of each of the tubes of the second row, whereby a flow of steam through the second row of tubes is reduced compared to a flow of steam through the first row of tubes.

10. A steam heat exchanger as claimed in claim 9, wherein the flow restrictor is elongated, having an internal opening with a first section and a second section, the first section being closer to the inlet header than the second section, the first section having a smaller internal cross-section than the second section, whereby steam exiting from the first section diverges and impacts of the flow restrictor along the second section.

11. A steam heat exchanger as claimed in claim 9, having three rows of tubes, the third row of tubes being between the first and second rows of tubes.

12. A heat exchanger as claimed in claim 9, wherein the flow restrictors are adjacent to the inlet ends of the tubes.

13. A steam heat exchanger for a wood pulp dryer, the heat exchanger having a first end, a second end which is opposite the first end, and comprising:

a plurality of tubes, each having an inlet end and an outlet end, the tubes extending between the ends of the heat exchanger in parallel, spaced-apart relationship to each other;

an outlet header near the second end of the heat exchanger, the outlet ends of the tubes being connected to the outlet header; and a steam inlet header near the first end of the heat exchanger, the inlet header having an inner conduit with an outer surface, a central axis, a connector at a first end thereof for connecting the inner conduit to a source of steam and a plurality of openings spaced-apart therein for discharging steam from the inner conduit, and an outer conduit extending about the inner conduit, the inlet ends of the tubes being connected to the outer conduit, the openings in the inner conduit each having a first end and a second end, the first end being closer to the first end of the inner conduit than the second end, the first end of said each opening being further from the central axis of the inner conduit than the second end thereof, the inner conduit having an outwardly extending edge adjacent the first end of each opening and an inwardly extending edge adjacent the second end of each opening.

14. A steam heat exchanger for a wood pulp dryer, the heat exchanger having a first end, a second end which is opposite the first end, a first side onto which air is directed, a second side which is opposite to the first side, and comprising:

a plurality of tubes, each having an inlet end and an outlet end, the tubes extending between the ends of the heat exchanger in parallel, spaced-apart relationship to each other, the tubes being arranged in a first row and a second row, the first row being adjacent to the first side of the heat exchanger and the second row being further from the first side than the first row;

an outlet header near the second end of the heat exchanger, the outlet ends of the tubes being connected to the outlet header;

a steam inlet header near the first end of the heat exchanger, the inlet ends of the tubes being connected to the inlet header, each of the tubes of the second row of tubes being connected to the inlet header by an elbow, each elbow having an end which is distal from the inlet header and which is connected to set each tube of the second row of tubes; and a flow restrictor located operatively between the inlet header and the outlet ends of each of the tubes of the second row, whereby a flow of steam through the second row of tubes is reduced compared to a flow of steam through the first row of tubes, each flow restrictor being adjacent to the end of one of the elbows.

* * * * *